United States Patent [19]

Trimmer et al.

[11] 4,407,480

[45] Oct. 4, 1983

[54] TEXTURED BRICK FORM

[75] Inventors: James E. Trimmer; Ross W. Worley, both of Kansas City, Mo.

[73] Assignee: Precise Forms, Inc., Kansas City, Mo.

[21] Appl. No.: 756,429

[22] Filed: Jan. 3, 1977

[51] Int. Cl.[3] ..... E04G 11/08

[52] U.S. Cl. ..... 249/189; 249/16

[58] Field of Search ..... 249/15, 16, 189–196

[56] References Cited

U.S. PATENT DOCUMENTS

| | | | |
|---|---|---|---|
| 953,720 | 4/1910 | Stoeser | 249/16 |
| 1,123,261 | 1/1915 | Edison | 249/16 |
| 1,776,999 | 9/1930 | Jenson | 249/15 |
| 3,307,822 | 3/1967 | Stout | 249/16 |
| 3,549,115 | 12/1970 | Williams | 249/192 |
| 3,899,155 | 8/1975 | Ward | 249/189 |

*Primary Examiner*—John McQuade

*Attorney, Agent, or Firm*—Schmidt, Johnson, Hovey & Williams

[57] ABSTRACT

A concrete form has an embossed forming panel for molding a facade of brickwork in a particular pattern on a concrete wall or the like. Specially constructed support flanges are secured to the marginal borders of the panel on the exterior face of the latter to prevent undesired deformation of the borders. Each flange has a panel engaging surface and a plurality of projections on the surface adapted to be received within depressions in the borders presented by the brickwork pattern. In the preferred embodiment, the panel is embossed to resemble an English cross-bond brickwork pattern, and the marginal borders vertically traverse the pattern through vertically aligned joints in alternate courses, the flanges having similarly arranged projections to be received within the spaced depressions presented by the aligned, vertically spaced joints.

3 Claims, 10 Drawing Figures

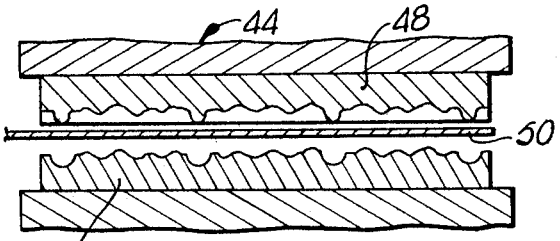
Fig. 1.
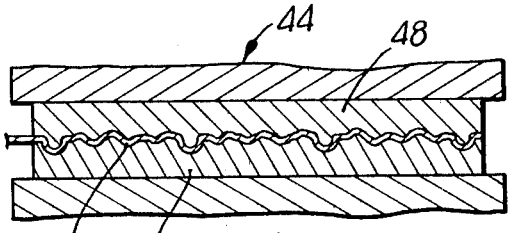
Fig. 2.
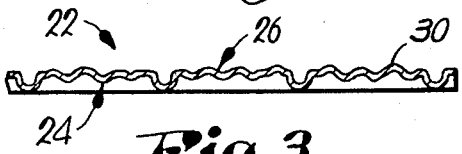
Fig. 3.
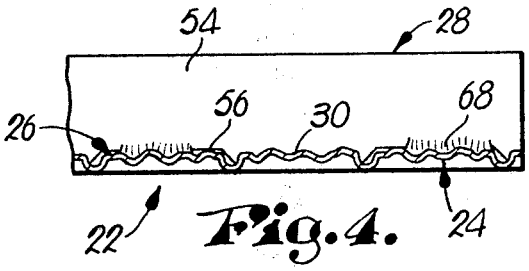
Fig. 4.
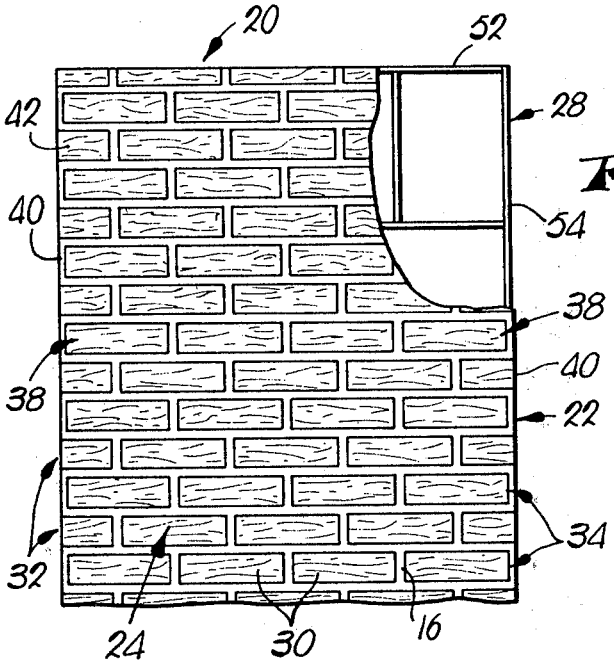
Fig. 5.
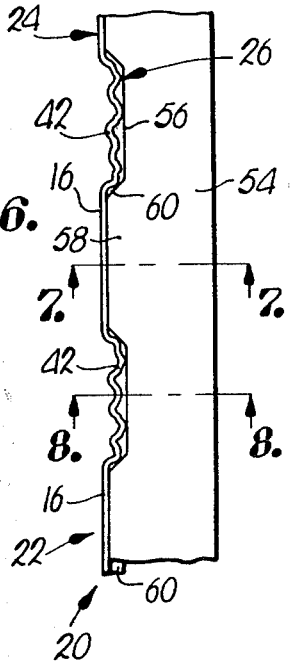
Fig. 6.
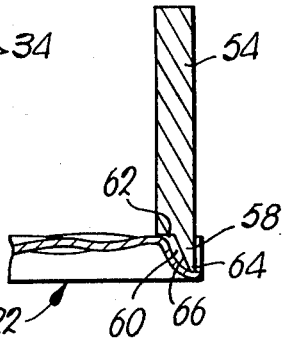
Fig. 7.
Fig. 9.
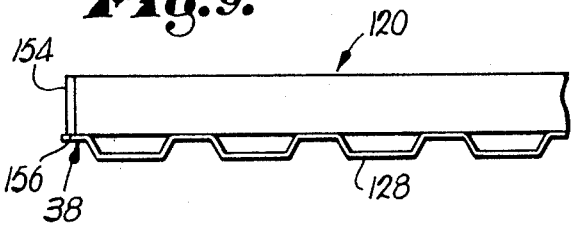
Fig. 8.
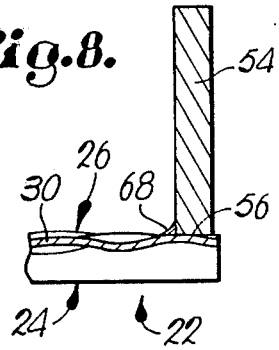
Fig. 10.
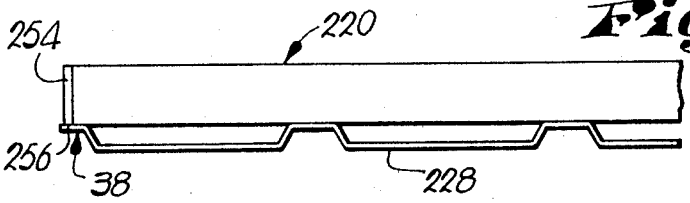

TEXTURED BRICK FORM

The present invention relates to concrete forms and more particularly concerns an improved embossed form of the type utilized to produce a masonry facade in a poured concrete wall or the like.

Modern concrete forming structures are typically erected using a plurality of prefabricated, interlocking form sections which may be reused indefinitely to produce any number of concrete structures. These form sections are necessarily of relatively high strength, yet preferably they are compact and lightweight to effect savings in handling, transportation, and storage. Hence, the sections are generally constructed from a panel of lightweight metal such as aluminum and have a reinforcing grid secured to the back side of the panel for providing the necessary strength to resist buckling under the weight of the poured concrete.

It has recently been the practice to construct form sections as described above from panels embossed with various designs to produce a decorative facade on the concrete wall formed by the sections. Thus, form sections are available having a bat and board pattern to resemble the exterior walls of a conventional frame house, a ribbed pattern to resemble aluminum sliding or the like, and a smooth brick pattern to resemble brickwork construction.

It has been desired to produce other more complex patterns in these form sections (i.e. textured brick or stonework) but such an advancement has heretofore been precluded due to an inability to cheaply manufacture suitable panels having complex designs formed therein. In this connection, attempts have been made to cast the panels but the inherent brittleness in cast material results in unsatisfactory strength and wear characteristics in sections formed from cast panels. Moreover, conventional metal stamping processes have proved prohibitively expensive since it was heretofore believed that the complex designs would necessitate forming the panels in several stages, thus requiring several sets of expensive forming dies and also necessitating costly heat treating procedures between each stamping operation.

Notwithstanding the problems of producing complex designs as discussed above, an additional problem common to all of the form sections having a masonry type pattern embossed therein is that of damage to the vertical marginal borders of the sections. In this regard, it is absolutely critical that these vertical marginal borders maintain their initial configuration inasmuch as the shape of the marginal borders influences the continuity in a wall formed by a plurality of form sections arranged side by side. For example, when the embossed pattern resembles smooth brickwork in an English cross-bond (joints between stretchers in one course positioned mid-length of stretchers in adjacent courses) the vertical edges of each panel traverse the pattern in such a manner as to present "half-bricks" in alternating courses along the vetical marginal borders of the sections. Thus, when sections so constructed are arranged side by side it is extremely important that the respective marginal borders match up exactly with their "half-bricks" precisely aligned to present a continuous full brick and hence, maintain the continuity of the brickwork pattern. However, in practice it has been found that form sections having a brickwork pattern as previously described often become deformed along the vertical marginal borders thereof after only a few uses such that subsequent use of the form results in an unsightly discontinuous facade on the poured concrete wall produced by the section.

Accordingly, it is an important object of the present invention to provide a form section having a masonry pattern embossed therein with support flanges along the vertical marginal borders of the section for preventing undesired deformation of the marginal borders.

In accordance with the foregoing object, it is a further important object of the present invention to provide a side flange for the form sections as described which flange has a plurality of projections extending from its panel engaging surface and adapted to be received within depressions in the back face of the panel created by the embossed pattern.

In the drawings:

FIG. 1 is a cross sectional view showing the form dies for producing a form section having a textured brick pattern;

FIG. 2 is a cross sectional view of the dies shown in FIG. 1 and illustrating the closed, stamping position of the dies;

FIG. 3 is a cross sectional view showing a panel produced by the dies illustrated in FIG. 1;

FIG. 4 is a partial, cross sectional view showing the panel of FIG. 3 with a reinforcing flange welded on the back face thereof;

FIG. 5 is a partial, front elevational view showing a form section constructed in accordance with the principles of the present invention and having parts thereof broken away to illustrate the reinforcing grid;

FIG. 6 is an enlarged, partial end view of the form section shown in FIG. 5;

FIG. 7 is a partial, enlarged, cross sectional view taken along line 7—7 of FIG. 6;

FIG. 8 is an enlarged, partial, cross sectional view taken alone line 8—8 of FIG. 6;

FIG. 9 is a partial plan view of an alternate embodiment of the form section having a rib pattern embossed therein; and FIG. 10 is a partial plan view showing a third embodiment of the form section having a bat and board pattern embossed therein.

A form section 20 is illustrated in FIG. 5 and includes a generally rectangular, substantially flat panel 22 having a front face 24 for contacting concrete or other poured construction material and an opposed back face 26, and a reinforcing grid 28 secured to the panel 22 on face 26. While only one section 20 is illustrated, it is to be understood that a plurality of sections 20 are normally employed in upright, side by side relationship to collectively comprise a form structure for temporarily supporting poured concrete or the like.

The panel 22 is embossed to present a textured brickwork pattern in the back face 26 and an impression of the pattern in the front face 24. The pattern is configured to represent brickwork in an English cross-bond having a plurality of stretchers in the nature of bricks 30 arranged in a number of alternate, horizontally extending courses 32 and 34. A vertically extending joint 16 is disposed between adjacent bricks in the courses 32, 34 with joints 16 in courses 32 being vertically aligned mid-length with bricks 30 in courses 34. A pair of upright marginal borders 38 extend along opposed lateral boundaries 40 of the panel 28. As shown for example in FIG. 5, the lateral boundaries 40 traverse courses 32, 34 in alignment with the vertical joints 16 of courses 34 such that a number of half-bricks 42 are presented in courses 32 at the marginal borders 38. It will be understood that the half-bricks in courses 32 are intended for alignment with similar half-bricks 42 in an adjacent panel 22 when a plurality of the form sections 20 are employed in forming a wall or the like.

The tooling for producing the textured brick pattern in panel 22 is illustrated in FIGS. 1 and 2. A die set 44 includes a punch 46 and a mating die 48 and is adapted for use in a conventional metalworking press (not shown). A metal sheet 50 is shown positioned in the die set in FIG. 1 and FIG. 2 shows the sheet 50 being stamped to produce the panel 22 shown in FIG. 3. It is important to note that the textured brick pattern embossed in the panel 22 is of a relatively complex nature as evidenced by the numerous indentations in irregularities in the surface of bricks 30.

In practice, the applicant has been able to form panels 22 having a textured brick pattern with only a single stamping operation and utilizing only one set of tooling, i.e., die set 44. Such single stage fabrication of the panels 22 was believed infeasible by those skilled in the art due to the thickness of the material and the severity of the draw needed to produce the desired pattern. However, the applicant has found that by casting die set 44 to very tight tolerances and specifying the material for sheet 50 as 5052 aluminum alloy (2.2–2.8% Mg, 0.15–0.35% Cr, balance Al) in the dead soft or O temper condition, he is able to satisfactorily form the panels as described above.

Once the panels have been formed, they are provided with a reinforcing gridwork 28 as described above to enable the panels to support a volume of poured concrete without buckling under the weight of the latter. The gridwork 28 comprises essentially a plurality of bars 52 arranged in a structural pattern and welded to the back face 26 of panel 22. The grid 28 further comprises a pair of elongate, support flanges 54 extending vertically along respective marginal borders 38 in laterally offset relation to the edges presented by boundaries 40 to protect the latter against undesired deformation.

As shown in FIG. 6, each flange 54 includes an elongate surface 56 extending along the length of the flange 54 and disposed in securing contact with the face 26. Surface 56 has a plurality of vertically spaced projections 58 adapted to be received within alternately spaced depressions 60 in marginal borders 38 as presented by joints 16 in courses 34 in relationship to half-bricks 42 of courses 32. Note that the projections 58 in combination with surface 56 assure that the marginal border 38 is firmly supported along its entire length such that the possibility of the border 38 being deformed from its initial configuration is greatly reduced.

In order to further enhance the tailored configuration of support flange 54 in relation to the marginal border 38 on the back face 26 of panel 22, the flange 54 is provided with a plurality of shelves 62 adjacent the bases of projections 58 for abutment against the bricks 30 in courses 34 immediately adjacent the lateral boundary 40. Additionally, the projections 58 are generally wedge-shaped in cross-section presenting a knife-like edge 64 and a beveled shoulder 66 extending between edge 64 and shelf 62. In this arrangement, the flange 54 is optimumly configured to assure a desired substantially continuous contact with the face 26 adjacent lateral boundary 40. As shown for exampled in FIG. 8, the flange 54 may be secured to panel 22 by a fillet weld 68 or the like.

In FIG. 9 there is shown a form section 120 constructed substantially the same as form section 20 with the exception that the section 120 has a panel 128 with a ribbed pattern embossed therein. Additionally, since the marginal borders 38 of panels 128 present a flat surface, section 120 has side flanges 154 which have a continuous unbroken contact surface 156 for engaging the panel 128.

Similarly, there is shown a form section 220 in FIG. 10 having a panel 228 embossed to present a bat and board pattern and including side flanges 254 with straight continuous contact surfaces 256.

As previously described, a plurality of sections 20 are normally secured together in upright side-by-side relationship for presenting a concrete forming structure. Of course, in this position the front face 24 is adapted to receive the poured concrete such that the pattern impressed in face 24 will ultimately appear on the formed concrete structure.

It is important to understand that the flanges 54 securely support marginal borders 38 along their full lengths such that they are at all times protected against undesired deformation. It has been found that forms having only intermittent support at the marginal edges thereof become significantly deformed at the edges after only a short period of use. Hence, the present invention provides an inexpensive means for greatly increasing the useful life of embossed form sections. In turn, this increased life makes it feasible to produce somewhat more expensive and complex embossed patterns such as textured brick and stone.

I claim:

1. A construction form including:

a normally upright panel embossed to present a masonry pattern in one face of the panel and an impression of said pattern in the opposite face, said pattern defining a plurality of offset courses, each having a series of stretchers, presenting a number of vertical joints between the stretchers with the joints in each course vertically misaligned relative to vertical joints in adjacent courses, said one face having a vertical, marginal border traversing said courses, said border terminating at one lateral edge of said panel, a number of said series of stretchers extending across said border to said edge, said border having a plurality of vertically spaced depressions defined by the joints in certain of said courses; and an elongate, vertical flange rigidly secured to said panel along said border for reinforcing said panel against buckling, said flange including a longitudinal surface contiguous with said border and in contact with the stretchers presented therealong, said surface having a plurality of vertically spaced projections disposed to be received within the depressions, whereby said surface contacts substantially the full length of said border to prevent deformation of the latter, said flange being laterally offset from said one edge.

2. A form as claimed in claim 1, wherein each of said projections has a shelf formed in its base, said shelf extending parallel to said surface in substantially coplanar relationship to the latter.

3. A form as claimed in claim 2, wherein each of said projections is transversely wedge-shaped, having an outermost sharp edge and a beveled shoulder extending between a respective shelf and said sharp edge.

* * * * *